US010046329B2

(12) United States Patent
Andersson et al.

(10) Patent No.: US 10,046,329 B2
(45) Date of Patent: Aug. 14, 2018

(54) GYRATORY CRUSHER TOPSHELL ASSEMBLY

(71) Applicant: SANDVIK INTELLECTUAL PROPERTY AB, Sandviken (SE)

(72) Inventors: Joel Andersson, Malmo (SE); Henrik Steede, Furulund (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 53 days.

(21) Appl. No.: 14/900,945

(22) PCT Filed: May 19, 2014

(86) PCT No.: PCT/EP2014/060251
§ 371 (c)(1),
(2) Date: Dec. 22, 2015

(87) PCT Pub. No.: WO2015/000627
PCT Pub. Date: Jan. 8, 2015

(65) Prior Publication Data

US 2016/0158761 A1 Jun. 9, 2016

(30) Foreign Application Priority Data

Jul. 5, 2013 (EP) ..... 13175308

(51) Int. Cl.
*B02C 2/04* (2006.01)
*B02C 2/06* (2006.01)

(52) U.S. Cl.
CPC ..... *B02C 2/04* (2013.01); *B02C 2/042* (2013.01); *B02C 2/06* (2013.01)

(58) Field of Classification Search
CPC ..... B02C 2/04; B02C 2/042; B02C 2/06
USPC ..... 241/207–216
See application file for complete search history.

(56) References Cited

U.S. PATENT DOCUMENTS

| | | | |
|---|---|---|---|
| 1,791,584 | A | 2/1931 | Symons |
| 2,509,920 | A | 5/1950 | Gruender |
| 5,769,340 | A | 6/1998 | Jean |
| 5,915,638 | A | 6/1999 | Jean |
| 6,536,693 | B2 | 3/2003 | Van Mullen et al. |
| 2007/0272780 | A1 | 11/2007 | Olsson et al. |
| 2009/0008489 | A1 | 1/2009 | Nieminen |

FOREIGN PATENT DOCUMENTS

| | | | |
|---|---|---|---|
| GB | 566840 | A | 1/1945 |
| GB | 1570015 | A | 6/1980 |
| JP | 2004136252 | A | 5/2004 |
| SU | 638360 | A1 | 12/1978 |
| WO | 2004110626 | A1 | 12/2004 |
| WO | 2008140375 | A1 | 11/2008 |
| WO | 2010123431 | A1 | 10/2010 |
| WO | 2012005651 | A1 | 1/2012 |

*Primary Examiner* — Faye Francis
(74) *Attorney, Agent, or Firm* — Corinne R. Gorski

(57) ABSTRACT

A gyratory crusher topshell assembly in which a spacer (filler) ring is mounted radially intermediate a topshell and an outer crushing shell. The spacer ring is locked axially at the topshell via a shape profile of the mating surfaces of the spacer ring and the topshell. Additionally, the spacer ring is rotationally locked at the topshell via contact between abutments extending between the spacer ring and the topshell.

11 Claims, 8 Drawing Sheets

GYRATORY CRUSHER TOPSHELL ASSEMBLY

RELATED APPLICATION DATA

This application is a § 371 National Stage Application of PCT International Application No. PCT/EP2014/060251 filed May 19, 2014 claiming priority of EP Application No. 13175308.9, filed Jul. 5, 2013.

FIELD OF INVENTION

The present invention relates to a gyratory crusher topshell assembly and in particular, although not exclusively, to a topshell and spacer ring positioned intermediate a crushing shell where the spacer ring is rotationally locked relative to the topshell via a plurality of rotational stops.

BACKGROUND ART

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2008/140375, WO 2010/123431, US 2009/0008489, GB 1570015, U.S. Pat. No. 6,536,693, JP 2004-136252, U.S. Pat. No. 1,791,584 and WO 2012/005651.

Primary crushers are heavy-duty machines designed to process large material sizes of the order of one meter. Secondary and tertiary crushers are however intended to process relatively smaller feed materials typically of a size less than 35 centimeters. Cone crushers represent a subcategory of gyratory crushers and may be utilised as downstream crushers due to their high reduction ratios and low wear rates.

Typically, a spacer (or filler) ring is used to accommodate different geometries of different concaves and in particular to adapt the same topshell for mounting medium or fine sized concaves used in secondary and tertiary crushers in contrast to the much larger diameter coarse concaves that fit directly against the topshell and have a maximum diameter to receive large objects for crushing. WO 2004/110626 discloses a gyratory crusher topshell having a plurality of different spacer ring embodiments for mounting a variety of different concaves at the crushing region.

Conventionally, the spacer ring comprises a radially outward facing cylindrical surface for mating against a corresponding inward facing cylindrical surface of the topshell. A form of anchorage is therefore required to axially lock the spacer ring at the topshell without which the spacer ring would be pushed axially upward by the crushing force imparted by the outer crushing shell during use. WO 2004/110626 describes the use of anchorage bolts that extend through a radially outward projecting flange of the spacer ring to be secured within a grooved region located at the upper rim of the topshell wall. These anchorage bolts are also configured to provide a radial lock for the spacer ring at the topshell without which the ring would rotate around the longitudinal axis due to the gyroscopic precession of the crushing head within the crushing chamber.

However, a spacer ring having an outwardly projecting flange can be difficult to install within the topshell due to the required closeness of fit. Additionally, due to the significant torque forces resultant from the crushing action, it is a common problem that these conventional mechanisms for axial and rotational locking of the spacer ring fail following only short or moderate usage. Accordingly, what is required is a topshell assembly that addresses these problems.

SUMMARY OF THE INVENTION

It is an objective of the present invention to provide a gyratory crusher topshell assembly that is configured to provide a strong and reliable locking mechanism to both axially and rotationally lock an intermediate spacer ring at a topshell for use with certain geometries of outer crushing shell. It is a further objective to provide a means of mounting and locking the spacer ring at the topshell configured to withstand the significant axial and torque forces imparted to the spacer ring during use whilst providing a spacer ring arrangement that is convenient to both install and remove from the topshell during maintenance and service procedures.

At least one objective is achieved by providing a topshell arrangement in which an axial lock of the spacer ring at the topshell is provided by specifically configuring the geometrical profile of the radially outward facing surface of the spacer ring and the corresponding radially inward facing surface of the topshell. In particular, and according to one embodiment, a spacer ring is provided with a mounting face to contact the topshell that tapers radially inward in the upward direction and a corresponding inward facing surface of a topshell that also tapers radially inward in the upward direction. Accordingly, the inclined annular surfaces provide a wedging lock effect to inhibit and indeed prevent upward axial movement displacement of the spacer ring beyond a predetermined position at the topshell. According to one embodiment, the spacer ring and topshell are configured with two or more annular mating regions such that at least one or two of these regions comprise corresponding radially inward tapering surfaces to provide a respective single or double locking action.

To satisfy at least one objective, the present topshell assembly is configured for reliable and robust anchorage of the spacer ring at the topshell to prevent rotational motion of the spacer ring relative to the topshell via corresponding abutments provided at both the spacer ring and topshell. In one embodiment, the abutments are provided by corresponding grooves formed at upper regions of both the topshell and spacer ring that accommodate intermediate bridging blocks seated within the grooves to provide rotational stops spaced apart circumferentially around the longitudinal axis so as to evenly distribute the torque forces and minimise stress concentrations at both the topshell and spacer ring. By dividing the mechanisms and means to achieve both axial and rotational lock of the spacer ring at the topshell, the effectiveness and reliability of each respective lock is optimised to provide a strong and durable topshell assembly configured to accommodate an intermediate spacer ring positioned radially between the topshell and various configurations of crushing shell (concave).

According to a first aspect of the present invention there is provided a gyratory crusher topshell comprising: an annular wall extending around a longitudinal axis, the wall terminated at an axially upper end by an annular rim; a plurality of first abutment regions provided at or projecting from the rim and spaced apart in a circumferential direction around the axis to cooperate with a plurality of second abutment regions spaced apart in the circumferential direction around the axis and provided at or projecting from an annular spacer ring positionable radially inside the wall; characterised in that: the annular spacer ring is formed as a unitary body; the first and second abutment regions are capable of being brought into touching contact with one another to provide a rotation lock of the spacer ring about the axis relative to the topshell; and at least a part of one of the first and/or second abutment regions extends in a radial direction relative to the axis to bridge the topshell and the ring.

Reference within the specification to a 'unitary body' refers to a spacer ring that is formed as a complete annular structure and is not formed from segments or sections in the circumferential direction. This term excludes a spacer ring formed from sections that are held and specifically coupled together within the region of the topshell or segments that are held loosely in place between the topshell and the outer crushing shell. This term may encompass a spacer ring formed as a composite structure formed two or more materials or a spacer ring formed from segments that are bound together or fused in such a way so as to form a unitary structure that is introduced into the topshell as such in contrast to being assembled within the topshell.

Preferably, a radially inward facing surface of the topshell comprises: an upper region positioned axially closest to the rim than a lower region of the inward facing surface and positioned radially closer to the axis than the lower region; wherein a part of a radially outward facing surface of the spacer ring is positioned in contact with the lower region such that the spacer ring is prevented from movement axially upward by the radial position of the upper region to axially lock the spacer ring relative to the topshell.

Preferably, the first abutment regions comprise a plurality of grooves. Preferably, the grooves are defined in part by side walls and the second abutment regions comprise a plurality of abutment bodies at least partially accommodated within the grooves and capable of abutment with the side walls.

Preferably, the abutment bodies comprise rigid blocks formed non-integrally with the spacer ring or topshell. Preferably, the grooves are provided at the annular rim of the topshell and the abutment bodies are attached to the spacer ring via respective attachment elements. The attachment elements may comprise threaded bolts cooperating with corresponding threaded holes within the spacer ring and/or topshell.

Preferably, the grooves comprise a first abutment face and each of the abutment bodies comprise a second abutment face such that the axial lock is provided by abutment of the respective first and second abutment faces.

Optionally, an upper end of the ring comprises recesses and each of the abutment bodies are seated within the respective recesses. Optionally, at least a part of the first and second abutment faces are aligned substantially perpendicular to a circumferential direction around the axis. Optionally, an upper end of the ring is substantially aligned coplanar with the rim.

Optionally, the topshell and topshell assembly comprises between two and eight respective first and second abutment regions. In some embodiments the assembly may comprise at least two abutment bodies operating between the spacer ring and the topshell. Optionally where the assembly comprises two bodies, they are positioned at diametrically opposed regions.

Preferably, the radially inward facing surface of the topshell tapers radially inward axially between the upper and lower regions and said part of the radially outward facing surface of the spacer ring tapers radially inward to mate against the tapered surface of the topshell to axially lock the ring at the topshell.

Optionally, the ring comprises raised upper and lower contact regions projecting radially outward and separated axially by an annular channel, the ring positioned in contact with the topshell via the upper and lower contact regions. Preferably, the radially outward facing surface of the ring at the upper and lower contact regions tapers radially inward in the axially upward direction. Optionally, the ring may comprise a single radially outward facing surface being devoid of an annular channel that would axially separate upper and lower contact regions. Optionally, at least a part of the single outward facing surface comprises a region that tapers radially inward in the axial direction.

According to a second aspect of the present invention there is provided a gyratory crusher topshell assembly comprising: a topshell having an annular wall extending around a longitudinal axis, the wall terminated at an axially upper end by an annular rim; a plurality of first abutment regions provided at or projecting from the rim and spaced apart in a circumferential direction around the axis; an annular spacer ring positioned radially inside the wall; characterised in that: the annular spacer ring is formed as a unitary body; a plurality of second abutment regions are provided at or project from the spacer ring and are spaced apart in the circumferential direction around the axis, the first and second abutment regions capable of being brought into touching contact with one another to provide a rotation lock of the spacer ring about the axis relative to the topshell; and wherein at least a part of one of the first and/or second abutment regions extend in a radial direction relative to the axis to bridge the topshell and the ring.

Preferably, the first and/or second abutment regions comprise abutment bodies extending radially between the topshell and ring to bridge and couple the topshell and the ring. Optionally, the abutment bodies project radially outward from the ring and radially inward from the topshell. Preferably, the abutment bodies are secured to the ring via attachment elements. Optionally, the abutment bodies may be secured to the topshell via attachment elements, welding or other means. Optionally, the spacer ring may comprise abutment bodies projecting axially upward from its uppermost annular face to be positioned either side of the abutment bodies extending from the top shell so that the abutment bodies are configured to contact one another and provide the rotational lock.

Optionally, an upper end of the ring comprises recesses; the rim comprises grooves; and each of the abutment bodies extends radially between and are seated at least partially within the respective recesses and grooves.

Preferably, an abutment face of the grooves and an abutment face of the recesses are aligned substantially perpendicular to a circumferential direction around the axis.

Preferably, the assembly further comprises an outer crushing shell having an upper region mounted radially inside the spacer ring, a radially outward facing surface of the crushing shell positioned in contact with a radially inward facing surface of the ring.

Optionally, the rotational lock of the ring at the topshell about the axis is provided exclusively by the touching contact between the first and second abutment regions. That is the rotational lock is independent of any attachment bolts associated with the topshell and/or spacer ring.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
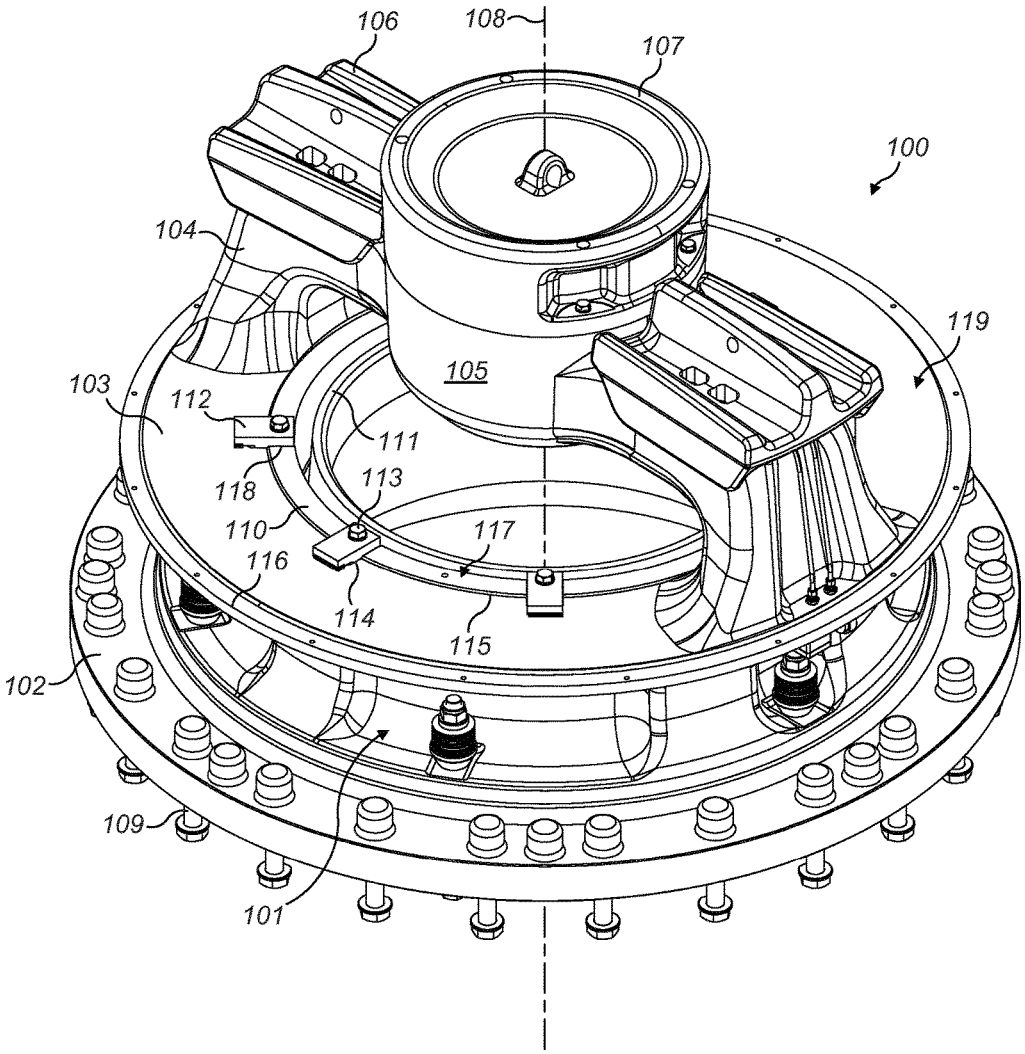
FIG. 1 is an upper perspective view of a topshell assembly having a topshell, an outer crushing shell and a spacer ring positioned radially intermediate the crushing shell and topshell.
Figure 2:
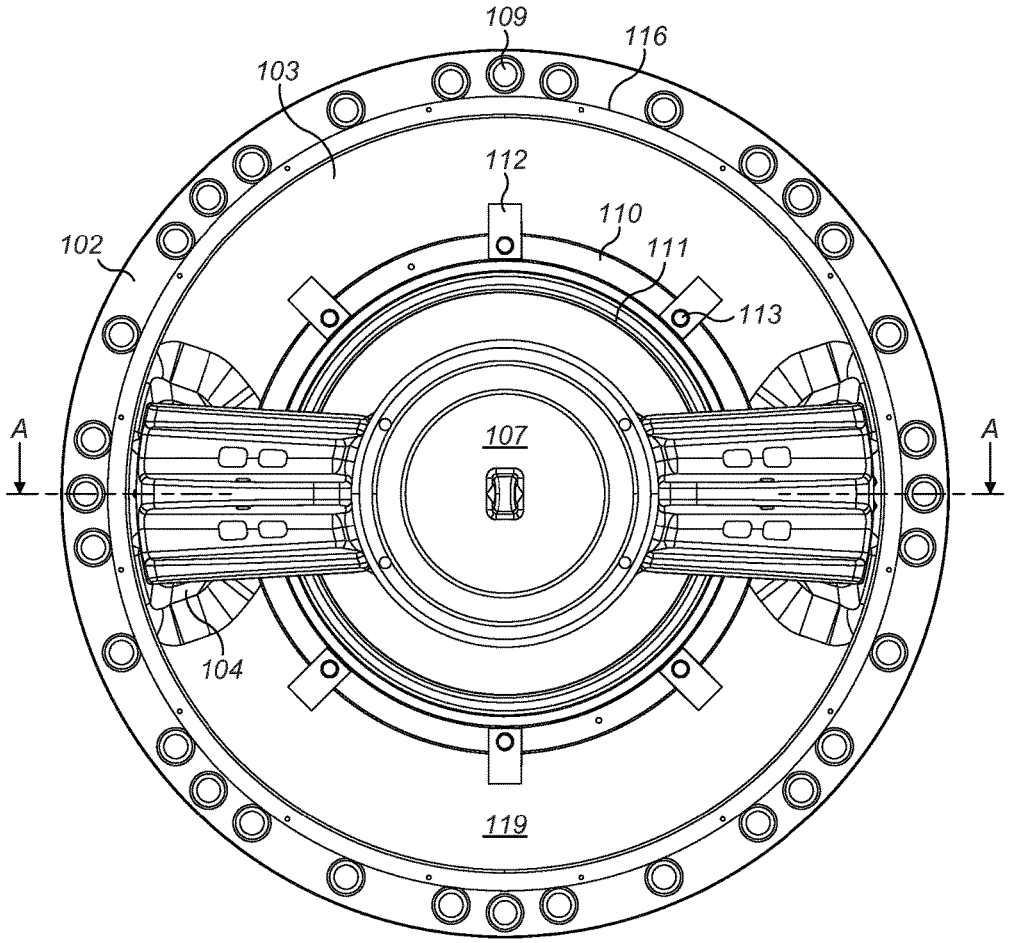
FIG. 2 is a plan view of the assembly of FIG. 1.

Referring to FIGS. 1 and 2, a gyratory crusher comprises a frame comprising a topshell 100 forming an upper part of the crusher and mountable upon a bottom shell (not shown) such that the topshell 100 and bottom shell together define an internal chamber. A crushing head (not shown) is mounted on an elongate main shaft (not shown) extending through the crusher in the direction of longitudinal axis 108. A drive (not shown) is coupled to the main shaft and is configured to rotate eccentrically about axis 108 via a suitable gearing (not shown) to cause the crushing head to perform a gyratory pendulum movement and to crush material introduced into the crushing chamber. An upper end region of the main shaft is maintained in an axially rotatable position by a top-end bearing assembly (not shown) accommodated within a central boss 105. Similarly, a bottom end of the main shaft is supported by a bottom-end bearing assembly (not shown) accommodated below the bottom shell.

Topshell 100 is divided into a chamber wall region 101 extending axially between an upper annular rim 103 and a lower annular rim 102 secured to the bottom shell. A spider forms an upper region of topshell 100 and is positioned axially above rim 103. The spider comprises a pair of spider arms 104 that project radially outward from central boss 105 to terminate at their radially outermost end at rim 103. Topshell 100 is secured to the bottom shell via anchorage bolt 109 extending through rim 102.

An outer crushing shell 111 is accommodated with the region of the wall 101 and comprises a generally concave configuration with respect to the radially outward facing surface. A spacer ring 110 is positioned radially intermediate crushing shell 111 and topshell wall region 101. Spacer ring 110 is rotationally locked at topshell 100 via a plurality of abutment bodies in the form of bridging blocks 112 that extends radially outward from ring 110 to contact rim 103 of topshell 100. In particular, a plurality of grooves 114 are indented into rim 103 and extend axially downward from an annular upper facing surface 119 of rim 103. Each of the grooves 114 is spaced apart circumferentially around axis 108 with six grooves 114 being provided in total. Each respective body 112 is accommodated at least partially within each groove 114. Similarly, a plurality of recesses 118 are formed in the upward facing annular surface 117 of ring 110 to accommodate at least partially a part of a respective body 112. Each body 112 is securely attached to ring 110 via anchorage bolts 113 that extend axially downward from annular surface 117 into the main body of ring 110. As illustrated in FIGS. 1 and 2, grooves 114 extend radially from a radially innermost edge 115 of rim 103 towards a radially outer edge 116 of rim 103. However, a radial length of grooves 114 is much less than the radial length between inner and outer edges 115, 116.

Figure 3A:
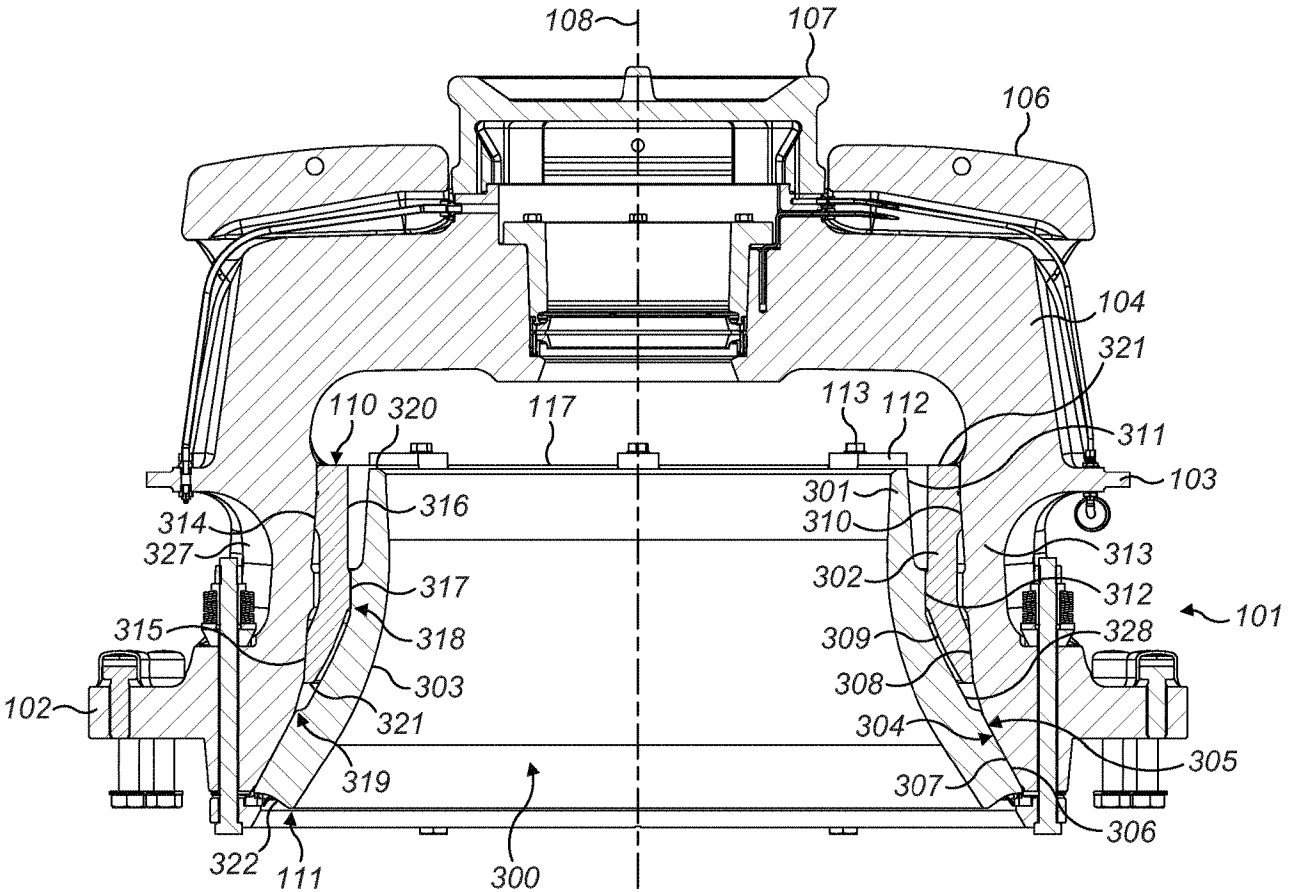
FIG. 3A is a cross sectional side view of the assembly of FIG. 2 through A-A.
Figure 3B:
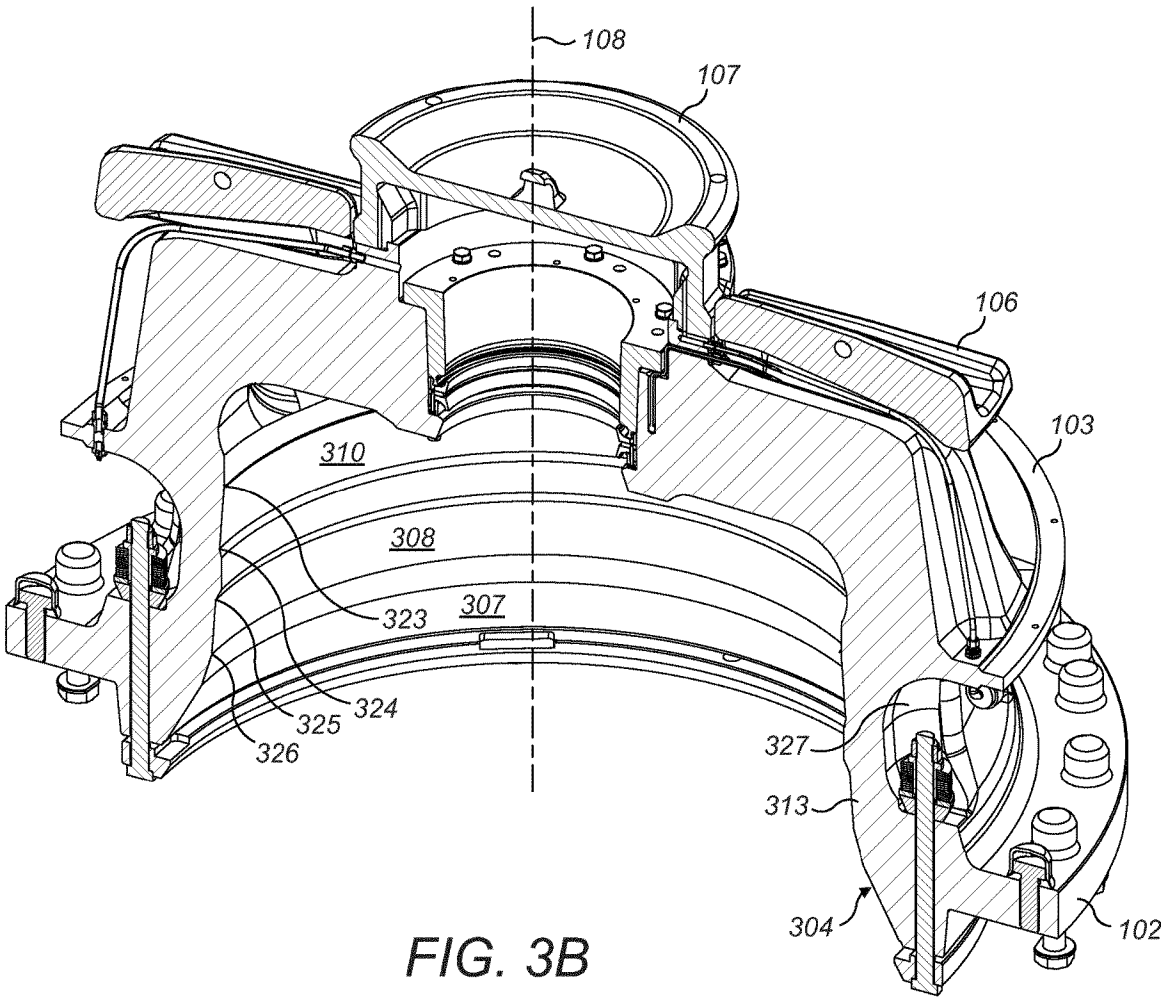
FIG. 3B is a perspective cross sectional view of the crusher assembly of FIG. 3A with the outer crushing shell and spacer ring removed for illustrative purposes.

Referring to FIGS. 3A and 3B, topshell wall region 101 comprises topshell wall 313 defined between a radially inward facing surface indicated generally by reference 304 and a radially outward facing surface 327 relative to axis 108. Inward facing surface 304 defines an internal chamber 300 through which material to be crushed is fed via an input hopper (not shown) mounted generally above topshell 100 via rim 103.

As illustrated in FIG. 3A, the outer crushing shell 111 is accommodated within chamber 300. Shell 111 extends circumferentially around axis 108 and comprises an inward facing crushing surface 303 and an opposed radially outward facing mount face indicated generally by reference 305 to define a wall 301 having a generally concave configuration at the region of the outward facing face 305. Wall 301 comprises a first annular upper end 320 and a second and lower annular end 322. Wall 301 is divided into a plurality of regions in the axial direction 108 in which a raised first (upper) contact region 318 is axially separated from a raised second (lower) contact region 319. The regions 318, 319 are separated by an axially intermediate groove 328. Region 318 is positioned in an axially upper half of shell 111 and region 319 is positioned in an axially lower half of shell 111. Upper contact region 318 comprises a radially outward facing contact surface 312 aligned substantially parallel with axis 108. Lower contact region 319 also comprises a radially outward facing contact surface 306 orientated transverse and inclined relative to axis 108.

Inward facing surface 304 of topshell wall region 101 is divided axially into a plurality of annular regions in the axial direction referring to FIG. 3B. A first (upper) mount region 310 is positioned axially uppermost towards rim 103. A second mount region is positioned axially lower than region 310 and towards rim 102. Second (lower) mount region is divided into an intermediate mount region 308 and a lowermost mount region 307 with intermediate region 308 positioned axially between upper and lowermost regions 310, 307 respectfully. Upper region 310 is defined in the axial direction by an axially upper annular section 323 and an axially lower annular section 324. The inward facing surface 304 at region 310 tapers radially inward towards axis 108 such that section 323 is positioned radially closer to axis 108 than section 324. Additionally, intermediate region 308 is defined in the axial direction by an axially upper annular section 325 and an axially lower annular section 326. Similarly, inward facing surface 304 tapers radially inward towards axis 108 such that section 325 is positioned radially closer to axis 108 than section 326. Lowermost region 307 also comprises a corresponding tapered inward facing surface 304.

An angle inclination of surface regions 308, 310 is approximately equal whilst a corresponding angle of inclination of surface region 307 is greater than regions 308, 310 relative to axis 108.

Crushing shell 111 is positioned in direct contact against topshell 100 via mating contact between lower contact surface 306 and the radially inward facing surface 304 of the lowermost mount region 307. Due to the function and geometry of crushing shell 111 the intermediate spacer ring 110 is positioned radially between the upper region 311 of shell 111 and topshell 100. In particular, spacer ring 110 comprises a radially outward facing surface having a first upper mount surface 314 and a corresponding second lower mount surface 315. Ring 110 also comprises a radially inward facing surface such that an annular wall 302 is defined between the inward and outward facing surfaces. Upper surface 314 is positioned in direct contact with topshell region 310 whilst the second lower mount surface 315 is positioned in direct contact with the intermediate mount region 308. The radially inward facing surface of ring 110 is divided axially into an upper region 316, a lower region 309 and an intermediate region 317. Intermediate region 317 is formed as an annular shoulder projecting radially inward relative to upper and lower regions 316, 309. According to the present implementation, the radially inward facing surface at shoulder 317 is positioned in direct contact with the radially outward facing upper contact surface 312. Accordingly, spacer ring 110 is positioned radially intermediate the upper region 311 of shell 111 and topshell wall 313.

An axially upper end 321 of ring 110 is positioned approximately co-planar with annular surface 119 and the upper end 320 of crushing shell 111. Additionally, a second and opposed lower end 321 of ring 110 is positioned axially between the upper and lower mount regions 318, 319 of shell 111 and radially within the region of the groove 328 defined, in part, by the upper and lower raised regions 318, 319.

Figure 5:
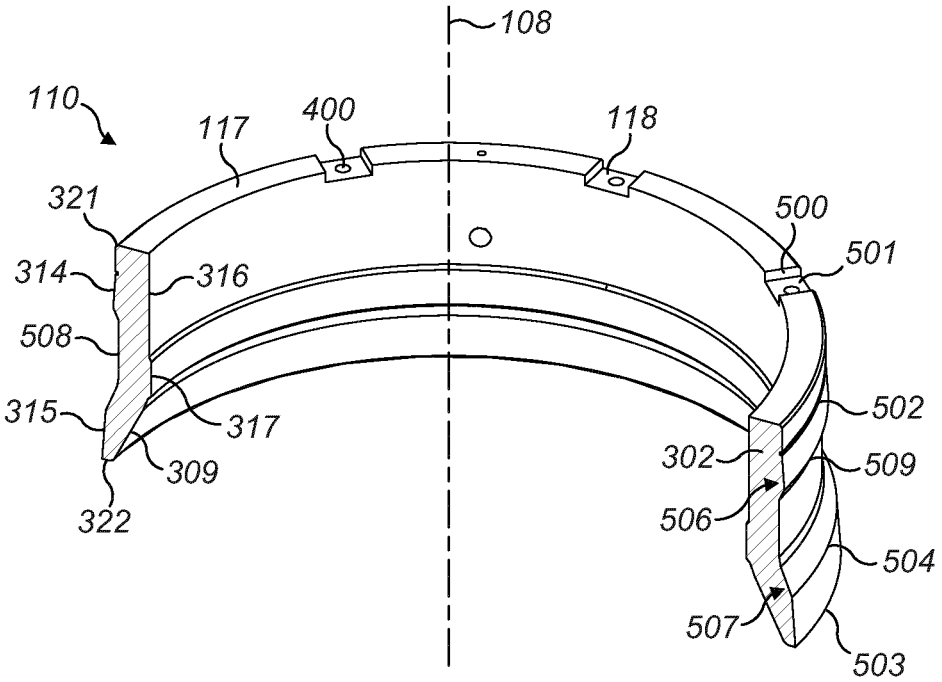
FIG. 5 is a cross sectional perspective view of the spacer ring of FIG. 3.

Referring to FIG. 5, spacer ring 110 is divided axially between upper end 321 and lower end 322 into a plurality of sections including in particular raised upper 506 and lower 507 contact regions projecting radially outward from wall 302 to provide respective upper and lower contact surfaces 314, 315 for mating against regions 310 and 308 of topshell 100 as described. Regions 506 and 507 are separated axially by a groove 508 in the radially outward facing surface. Shoulder 317 projects radially inward from wall 302 at an axial position corresponding to the region of groove 508. Upper mount surface 314 is defined axially by an upper annular section 502 and an axially lower annular section 509. Similarly, second lower mount surface 315 is defined axially by an annular upper section 504 and an axially lower annular section 503. According to the specific implementation, surfaces 314 and 315 taper radially inward towards axis 108 in the axially upward direction such that sections 502 and 504 are positioned radially closer to axis 108 than the respective lower sections 509, 503. As illustrated, the radially inward facing surface at upper region 316 is substantially cylindrical whilst the corresponding radially inward facing surface at lower region 309 tapers radially inward towards axis 108 in the upward direction from lower end 322. Accordingly, the axial lock of spacer ring 110 at topshell 100 is provided by the mating contact between the cooperating tapered surfaces 314 and 315 at the spacer ring with the tapering surface regions 310, 308 of topshell 100. In particular, the respective lower sections 324, 326 of the topshell are mated with the respective lower sections 509 and 503 of the ring 110 together with a corresponding mating between the respective upper sections 323, 325 of the topshell 100 and the respective upper sections 502, 504 of the ring 110. Due to the closeness of fit of ring 110 within annular wall 101, ring 110 is prevented from movement in the axially upward direction due to the wedging action provided by the axially spaced pair of annular mating surfaces between the topshell 100 and spacer ring 110.

Figure 4:
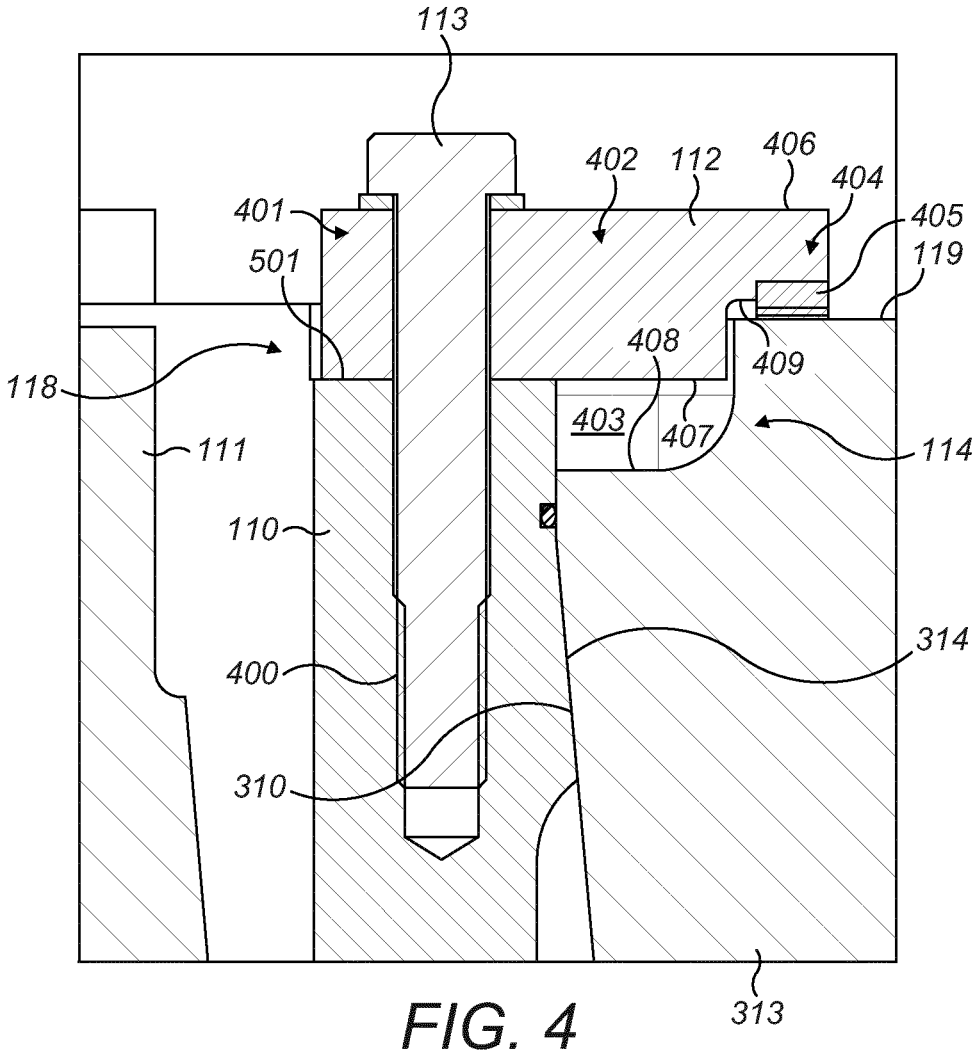
FIG. 4 is a magnified cross sectional view of an upper region of the spacer ring located at the topshell.

Referring to FIG. 4, the rotational lock of ring 110 at topshell 100 is provided by the plurality of abutments 112, 114, 118 distributed circumferentially around axis 108 and provided at topshell 100 and spacer ring 110. Referring to FIGS. 5 and 7, the circumferentially spaced recesses 118 within upper surface 117 of ring 110 are defined, in part, by respective opposed side faces 500 and a trough face 501. A threaded borehole 400 extends axially downward from trough face 501 into wall 302 to provide a means of receiving threaded bolts 113. As illustrated, recesses 118 extend the full radial length of wall 302 so as to provide circumferentially spacer notches in the upper surface 117 of ring 110. Referring to FIG. 7, corresponding grooves 114 are indented into upward facing surface 119 at corresponding circumferentially spaced intervals such that by rotational adjustment of ring 110 within wall 313, it is possible to circumferentially align grooves and recesses 114 and 118. Each groove 114 is in turn defined by opposed side faces 700 and a lower trough face 408. However, a depth groove 114 is greater than recess 118 such that trough face 408 is positioned axially below trough face 501. Additionally, in the orientation illustrated in FIGS. 1 to 7, corresponding side faces 500 and 700 are positioned approximately co-planar.

Figure 6:
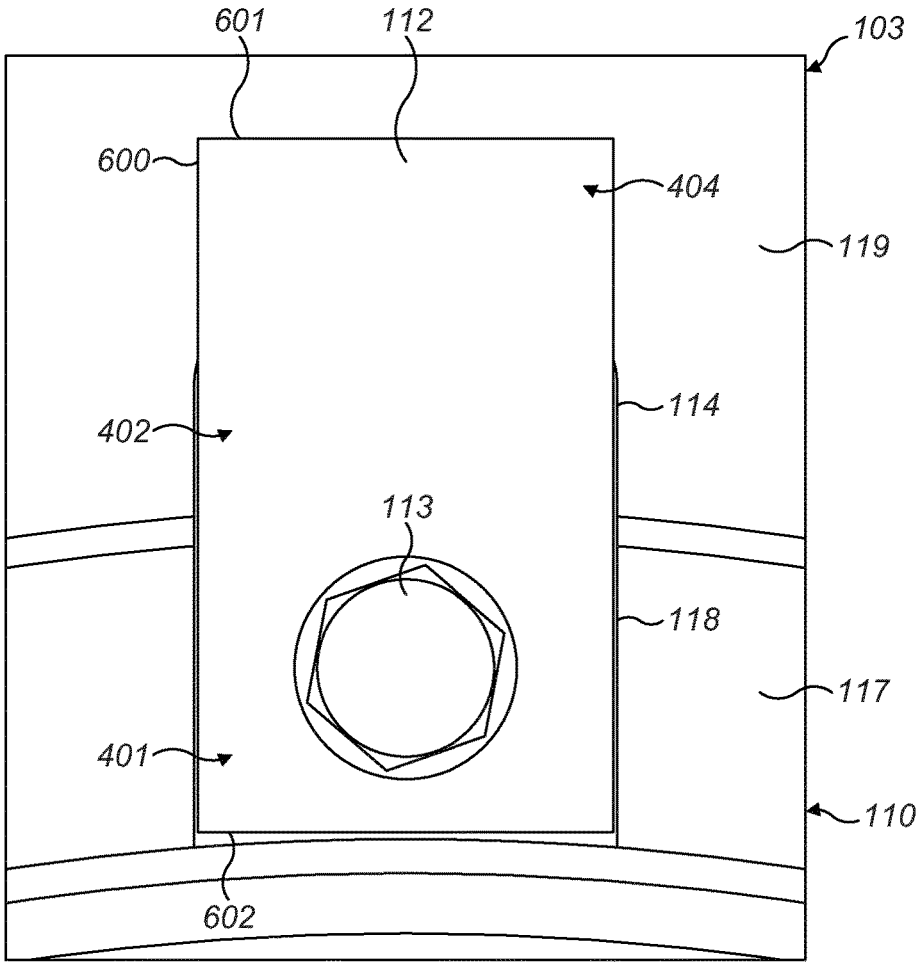
FIG. 6 is a plan view of a rotational lock extending between the topshell and spacer ring of FIGS. 1 to 4.
Figure 7:
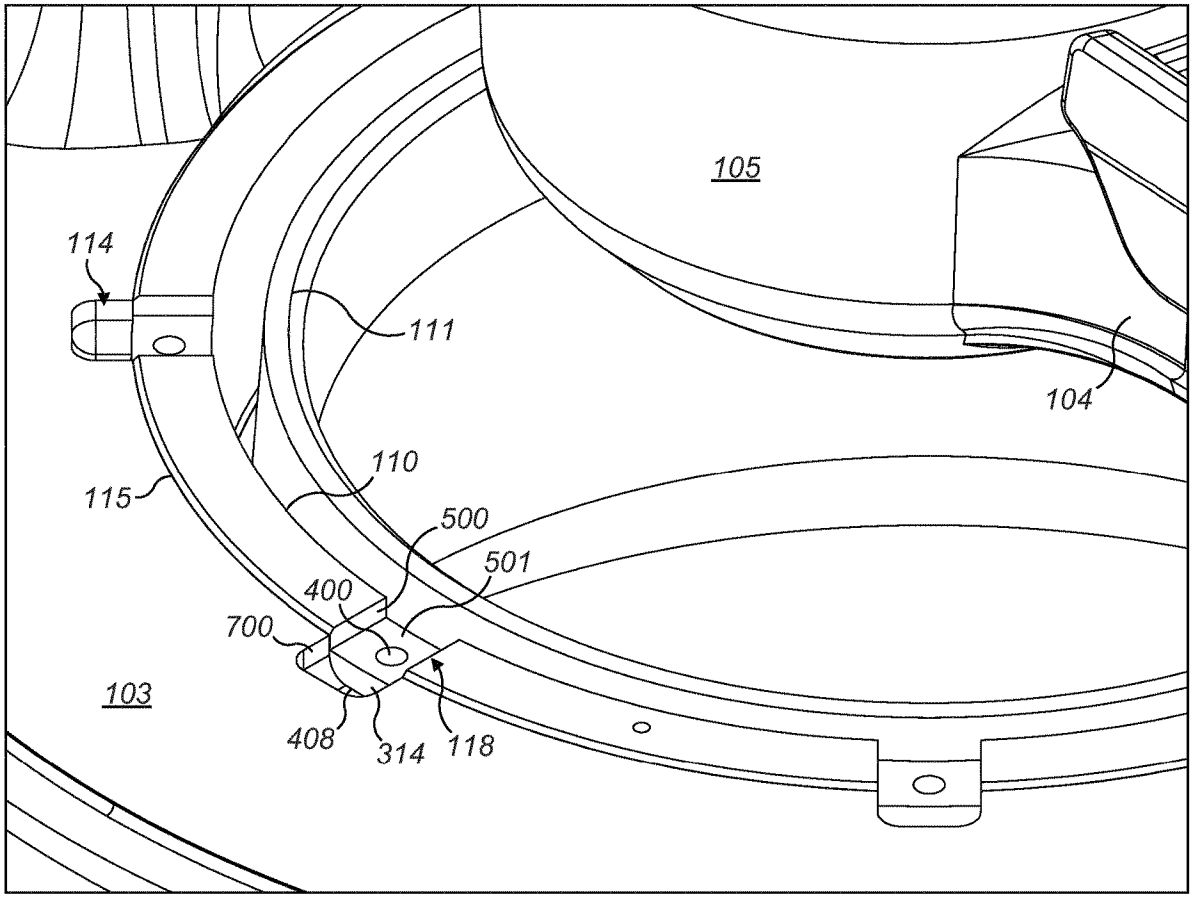
FIG. 7 is magnified upper perspective view of a region of the assembly of FIG. 1 with a part of the rotational lock removed for illustrative purposes.

Referring to FIGS. 4 and 6, bridging blocks 112 comprise a generally rectangular cuboid geometry having an upper face 406, a opposed lower face 407, 409, lengthwise side face 600 and widthwise end faces 601, 602. Additionally, each block 112 may be divided in its lengthwise direction between widthwise faces 601, 602 into a first region 401 for positioning within a spacer ring recess 118; a second region 402 for positioning within a topshell groove 114 and a third region 404 for positioning above upward facing surface 119 of rim 103. In particular, lower face 407 is accommodated within groove 114 (positioned opposed to trough face 408) and is also accommodated within recess 118 (positioned in contact with trough face 501). Due to a depth of groove 114 a spatial gap 403 is provided between the opposed lower face 407 and trough face 408.

As will be appreciated, during use it is common for the intermediate spacer ring to be compressed radially and hence to elongate axially. To compensate for this, shim block 405 are positioned axially intermediate upward facing surface 119 of rim 103 and the downward facing lower surface 409 of block 112. According to the specific embodiment, a thickness in the axial direction of block 112 decreases from region 402 to region 404 to provide a stepped cross sectional profile as illustrated in FIG. 4 with shim blocks 405 positioned underneath the radially outer region 404 located above upward facing surface 119 that is thinner than region 402 in the axial direction.

Referring to FIG. 6, the rotational lock of ring 110 at topshell 100 is provided principally by the abutment of lengthwise face 600 with the side faces 700 and 500 of the respective grooves 114 and recesses 118. That is, each block 112 is at least partially accommodated within the circumferentially aligned groove and recess 114, 118 so as to represent an obstruction to rotational motion of ring 110 about axis 108. According to the specific implementation, faces 700 and 500 are aligned vertically (parallel with axis 108 and perpendicular to the circumferential direction illustrated for example by edge 115). This configuration is therefore optimised to absorb and transmit the torque force by ring 110 to topshell 100 via the intermediate bridging blocks 112 accommodated within the respective grooves 114 and recesses 118. According to the specific implementation, a separation distance between lengthwise faces 600 and side faces 700 and 500 is of the order of 1 mm. This close-fit tolerance ensures there is no or minimal 'rotational slack' on initial start-up of the crusher to provide an immediately effective rotational lock of ring 110. According to the present configuration, as the torque force is transmitted through blocks 112 and corresponding abutment faces 700 and 500, bolts 113 are isolated from experiencing sheer stress, in turn, providing a robust multi-component rotational lock. As illustrated in FIGS. 4 and 7, the transition of side face 700 to trough face 408 follows an arcuate or curved surface path to minimise any stress concentrations at the grooves 114.

According to further specific embodiments, blocks 112 may be moveably mounted at ring 110 via suitable mountings for example including sliding or pivoting attachments. According to a further embodiment, blocks 112 are permanently attached to ring 110 and may be integrally formed with ring wall 302.

The invention claimed is:

1. A gyratory crusher topshell comprising:

an annular wall extending around a longitudinal axis, the wall being terminated at an axially upper end by an annular rim;

a plurality of first abutment regions provided at or projecting from the rim and spaced apart in a circumferential direction around the axis to cooperate with a plurality of second abutment regions spaced apart in the circumferential direction around the axis and provided at or projecting from an annular spacer ring positionable radially inside the, the annular spacer ring being formed as a unitary body, wherein the first and second abutment regions are capable of being brought into touching contact with one another to provide a rotation lock of the spacer ring about the axis-relative to the topshell, at least a part of one of the first and/or second abutment regions extending in a radial direction relative to the axis to bridge the topshell and the ring; and a radially inward facing surface of the topshell, which includes an upper region positioned axially closest to the rim than a lower region of the inward facing surface and positioned radially closer to the axis than the lower region, a part of a radially outward facing surface of the spacer ring being positioned in contact with the lower region such that the spacer ring is prevented from movement axially upward by the radial position of the upper region to axially lock the spacer ring relative to the topshell.

2. The topshell as claimed in claim 1, wherein the first abutment regions include a plurality of grooves.

3. The topshell as claimed in claim 2, wherein the grooves are defined in part by side walls and the second abutment regions include a plurality of abutment bodies at least partially accommodated within the grooves and capable of abutment with the side walls.

4. The topshell as claimed in claim 3, wherein the abutment bodies are formed non-integrally with the spacer ring or topshell.

5. The topshell as claimed in claim 4, wherein the grooves are provided at the annular rim of the topshell and the abutment bodies are attached to the spacer ring via respective attachment elements.

6. The topshell as claimed in claim 3, wherein each of the grooves has a first abutment face and each of the abutment bodies has a second abutment face such that the axial lock is provided by abutment of the respective first and second abutment faces.

7. A gyratory crusher topshell assembly comprising:

a topshell having an annular wall extending around a longitudinal axis, the wall being terminated at an axially upper end by an annular rim;

a plurality of first abutment regions provided at or projecting from the rim and spaced apart in a circumferential direction around the axis;

an annular spacer ring positioned radially inside the wall, the annular spacer ring being formed as a unitary body, wherein an upper end of the ring is substantially aligned coplanar with the rim; and a plurality of second abutment regions provided at or projecting from the spacer ring and being spaced apart in the circumferential direction around the axis, wherein the first and second abutment regions are capable of being brought into touching contact with one another to provide a rotation lock of the spacer ring about the axis relative to the topshell, at least a part of one of the first and/or second abutment regions extending in a radial direction relative to the axis to bridge the topshell and the ring, wherein the first and/or second abutment regions include abutment bodies extending radially between the topshell and ring to bridge and couple the topshell and the ring, an upper end of the ring including recesses and the rim including grooves, each of the abutment bodies radially extending between and seated at least partially within the respective recesses and grooves.

8. The assembly as claimed in claim 7, wherein an abutment face of the grooves and an abutment face of the recesses are aligned substantially perpendicular to a circumferential direction around the axis.

9. The assembly as claimed in claim 7, comprising between two and eight respective first and second abutment regions.

10. The assembly as claimed in claim 7, wherein a radially inward facing surface of the topshell includes an upper region positioned axially closest to the rim than a lower region of the inward facing surface and positioned radially closer to the axis than the lower region, a part of a radially outward facing surface of the spacer ring being positioned in contact with the lower region such that the spacer ring is prevented from movement axially upward by the radial position of the upper region to axially lock the spacer ring relative to the topshell.

11. The assembly as claimed in claim 10, wherein the radially inward facing surface of the topshell tapers radially inward axially between the upper and lower regions and said part of the radially outward facing surface of the spacer ring tapers radially inward to mate against the tapered surface of the topshell to axially lock the ring at the topshell.

* * * * *